US010173252B2

(12) United States Patent
Ernst De La Graete et al.

(10) Patent No.: US 10,173,252 B2
(45) Date of Patent: Jan. 8, 2019

(54) ROLLING MILL PROVIDED WITH AT LEAST ONE COOLING NOZZLE

(71) Applicant: FIVES DMS, Noyelles-les-seclin (FR)

(72) Inventors: Conrad Ernst De La Graete, Noyelles-les-seclin (FR); Bernard Roggo, Noyelles-les-seclin (FR)

(73) Assignee: FIVES DMS, Noyelles-les-Seclin (FR)

( * ) Notice: Subject to any disclaimer, the term of this patent is extended or adjusted under 35 U.S.C. 154(b) by 387 days.

(21) Appl. No.: 14/906,804

(22) PCT Filed: Jul. 17, 2014

(86) PCT No.: PCT/FR2014/051834
§ 371 (c)(1),
(2) Date: Jan. 21, 2016

(87) PCT Pub. No.: WO2015/011373
PCT Pub. Date: Jan. 29, 2015

(65) Prior Publication Data

US 2016/0167097 A1 Jun. 16, 2016

(30) Foreign Application Priority Data

Jul. 22, 2013 (FR) ..... 13 57186

(51) Int. Cl.
*B21B 13/14* (2006.01)
*B21B 45/02* (2006.01)
(Continued)

(52) U.S. Cl.
CPC ..... *B21B 45/0233* (2013.01); *B21B 13/145* (2013.01); *B21B 27/10* (2013.01);
(Continued)

(58) Field of Classification Search
CPC . B21B 2013/028; B21B 13/14; B21B 13/145; B21B 13/147; B21B 37/32;
(Continued)

(56) References Cited

U.S. PATENT DOCUMENTS 4,531,394 A 7/1985 Turley et al.
4,631,948 A 12/1986 Bald et al.
(Continued)

FOREIGN PATENT DOCUMENTS

EP 0 121 811 A1 10/1984
EP 1 721 685 A1 11/2006
(Continued)

OTHER PUBLICATIONS

International Search Report, dated Jan. 15, 2015, from corresponding PCT Application.

*Primary Examiner* — Edward Tolan
(74) *Attorney, Agent, or Firm* — Young & Thompson

(57) ABSTRACT

Rolling mill (1) includes:
side bearing rollers (5), able to laterally support the working rollers (2) of the rolling mill, with each side bearing roller being carried by a support arm (6), mounted pivoting on an axis (7),
load distribution beams (8) extending between the corresponding posts of each pair, and elements (9) for applying a preload force on each support arm (6), intended to engage with one of the support arms on a bearing surface (10), and including at least one preload cylinder (11) integral with one of the load distribution beams (8),
one or several spraying nozzles for a lubricant/cooling fluid, at least one of the nozzles (12, 12'), is embedded on one of the support arms (6) and the fluid supply
(Continued)

circuit of the at least one nozzle (12, 12') includes a connection/disconnection device (13) with the support arm (6).

19 Claims, 3 Drawing Sheets

(51) Int. Cl.
*B21B 27/10* (2006.01)
*B21B 13/02* (2006.01)

(52) U.S. Cl.
CPC ..... *B21B 45/0218* (2013.01); *B21B 45/0251* (2013.01); *B21B 2013/028* (2013.01); *B21B 2203/06* (2013.01)

(58) Field of Classification Search
CPC ..... B21B 37/44; B21B 37/74; B21B 45/0218; B21B 45/0233
See application file for complete search history.

(56) References Cited

U.S. PATENT DOCUMENTS

| | | | | |
|---|---|---|---|---|
| 4,763,505 | A * | 8/1988 | Klute | B21B 13/145 72/238 |
| 6,041,636 | A | 3/2000 | Datzuk et al. | |
| 7,185,522 | B2 * | 3/2007 | Turley | B21B 13/145 72/201 |
| 8,966,951 | B2 * | 3/2015 | Cronier | B21B 27/10 72/201 |
| 2011/0278367 | A1 | 11/2011 | Cronier et al. | |
| 2012/0324973 | A1 | 12/2012 | Charre et al. | |
| 2015/0336146 | A1 * | 11/2015 | Charre | B21B 27/10 72/43 |

FOREIGN PATENT DOCUMENTS

| | | | |
|---|---|---|---|
| WO | 2004/052568 | A1 | 6/2004 |
| WO | 2010/086514 | A1 | 8/2010 |
| WO | 2011/107165 | A1 | 9/2011 |

* cited by examiner

ROLLING MILL PROVIDED WITH AT LEAST ONE COOLING NOZZLE

The invention relates to a rolling mill, and relates more particularly to the aspect of the cooling and/or of the lubrication of the rollers of such a rolling mill.

The field of the invention is more particularly that of rolling mills with a Sexto stand supported laterally, and in particular rolling mills known under the name "Z High".

These rolling mills have their application, on-line, for example, in annealing and pickling lines or, off-line, as reversible rolling mills, for metal strips.

A Quarto stand rolling mill comprises a retaining stand wherein are provided four rollers with parallel axes, namely respectively two working rollers, lower and upper, defining the passage gap of the strip to be rolled, as well as two bearing rollers, upper and lower, bearing respectively on the working rollers of the side opposite that of the passage gap.

A Sexto rolling mill comprises two additional rollers in relation to a Quarto, namely two intermediate rollers respectively inserted between each working roller and the corresponding bearing roller.

In such rolling mills, each bearing roller and each intermediate roller, is mounted rotating at its ends on chocks, by the intermediary of bearings, for example with bearings or hydrostatic bearings. These chocks are supports which can be moved according to a direction parallel to the clamping plane, between the two posts of the stand.

Conventionally, balancing cylinders allow for the displacement of the chocks of the intermediate rollers. These balancing cylinders make it possible to change the relative position of the chocks and of their roller, making it possible among other things, to open the stand in order to facilitate the engagement of the product to be rolled, or again to move these elements in order to facilitate the removal of the rollers. These balancing cylinders can also make it possible to camber the intermediate rollers.

An advantage of a Sexto stand rolling mill is the possibility of using, compared to a Quarto stand, working rollers of a smaller diameter, which makes it possible to obtain a higher reduction of the thickness of the product to be rolled, for the same rolling force.

A Sexto rolling mill moreover offers the possibility to axially offset the two intermediate rollers, and with the purpose of applying the rolling force only on the width of the strip to be rolled, not over the entire length of the working rollers.

In a Sexto rolling mill referred to as "laterally supporting", very often, the working rollers are not mounted on chocks, but on the contrary provided as floating. It is then required to maintain their axial position, by the intermediary of axial abutments, but also to maintain their lateral position using side bearing members, such as roller wheels or side bearing roller barrels arranged on either side of the clamping plane.

It is known, for example, from document EP 0121 811, in particular from the embodiment of FIG. 2, such a rolling mill of the Sexto type that comprises two working rollers, two bearing rollers and two intermediate rollers, inserted respectively between one of the working rollers and the corresponding bearing roller. In this document, the working rollers, the intermediate rollers and the bearing rollers are all mounted on chocks.

Each working roller is laterally supported, on either side of the working roller, by two pairs of roller wheels. The roller wheels of the same pair are provided on the two ends of each working roller, on the ends of the roller that are not in contact with the strip to be rolled. The roller wheels are mounted as a pivot on forks mobile in translation in relation to the post of the stand, under the action of hydraulic cylinders.

In FIG. 6 of this document, embedded nozzles on the support portion of the roller wheels are provided, mobile in relation to the post of the stand. To this effect, hoses are used to supply the nozzles with cooling and/or lubrication products, with the hoses making it possible to take account of the movements between the support portion, mobile, and the posts of the stand. These nozzles allow for the lubrication and the cooling of the roller wheels and of the working roller, on the bearing zone of the roller wheels.

It is further known from document U.S. Pat. No. 4,531,394 another rolling mill design, of the Sexto type supported laterally. Such a rolling mill still comprises two working rollers, two bearing rollers and two intermediate rollers, inserted respectively between one of the working rollers and the corresponding bearing roller. In this document, the bearing rollers and the intermediate rollers are mounted at their ends on chocks, while the working rollers are provided floating. Each working roller is supported laterally, on each side of the working roller, by a side bearing roller, itself bearing on two series of roller wheels arranged over the length of the roller.

In this rolling mill design, for each working roller, the two corresponding side bearing rollers are integral with two chocks of said intermediate roller. Each side bearing roller, as well as its bearing roller wheels are mounted on a support arm that extends between the two chocks of the intermediate roller, with each support arm being mounted pivoting around a shaft of which the ends are integral with chocks.

The set of intermediate roller, chocks of the intermediate roller, support arm, (right and left), roller wheels and side bearing rollers, right and left, forms a self-bearing unit, commonly called a "cassette" or "insert" which can be introduced into the stand, or removed from the stand, during maintenance, by sliding the unit according to the direction of the rollers.

Four load distribution beams extend rigidly between the two posts of the stand, respectively, facing each support arm. Each load distribution beam supports a beam, referred to as preload, mobile in translation in relation to the corresponding load distribution beam, which can be moved towards the interior of the stand according to a substantially horizontal direction. Preload cylinders make it possible to stress the beam mobile in contact with the pivoting support arm in order to preload the side bearing roller on the working roller.

In such a rolling mill, the cooling and the lubrication of the working roller and of the intermediate roller are carried out using nozzles, referenced respectively as 73 and 72 in FIG. 2 of document U.S. Pat. No. 4,531,394, physically at a distance from the working roller, located outside of the "insert" or of the "cassette". In FIG. 2, these nozzles are made integral with the load distribution beam, or, with the mobile preload beam. So that the stream can reach the intermediate roller, the nozzles, referenced as 72 are facing bores passing through the support arms. In practice and to the best knowledge of the inventors, this solution of spraying by the intermediary of bores of the support arms does not seem to be retained in rolling mills implemented industrially.

According to the observations of the inventors, the spraying nozzles, referenced as 73 are not able to correctly cool the working roller barrel because they are located too far from the latter, with their streams coming too quickly as interference with the side support arms, roller wheels and side bearing roller barrels and therefore unable to go back up the scrolling of the strip. On the other hand, according to the observations of the inventors, the nozzles referenced as 72 are not capable of correctly lubricating the contact between the working roller barrel and the intermediate roller because they are located too far away from the latter. In use, such rolling mills with inserts, have a limited lifespan for the working roller, due to its poor cooling.

It is further known from document U.S. Pat. No. 6,041,636 another design of a rolling mill of the Sexto type supported laterally, with "insert" or "cassette". As in the preceding document, the set of intermediate roller, chocks of the intermediate roller, support arm, (right and left), roller wheels and side bearing rollers, right and left, forms a self-bearing unit which can be introduced into the stand or removed from the stand during maintenance, by sliding the unit according to the direction of the rollers.

In this document U.S. Pat. No. 6,041,636, the chocks of the intermediate rollers are mounted on camber blocks. The cylinders of the camber blocks make it possible, during operating, to approach the intermediate rollers, in a working position shown in FIG. 5 of this document, or to separate the intermediate rollers to a position, shown in FIG. 4, allowing for the removal of the inserts by sliding. These cylinders can make it possible also, during operating to camber the intermediate roller.

In this document, it is known to supply with lubricant the bearings of the roller wheels of the support arms of the insert, using a source of lubricant. Connection/disconnection devices make it possible, in the working position of the rollers, to connect the source of lubricant to lubrication bores provided in the chocks, and to automatically disconnect the bores when the intermediate rollers and their chocks are vertically separated by the camber blocks. This automatic connection/disconnection is advantageous. No additional operation to connect/disconnect the source of lubricant is required during maintenance, in particular when the inserts have to be removed or introduced into the stand. To this effect, each connection device comprises an element, referenced as 57 called a "plunger", hollow, intended to convey the lubricant, and which makes it possible, in the working position of the intermediate rollers, such as shown in FIG. 9, to attach in a relatively sealed manner the bore of the chock by the intermediary of a seal. This element is mobile, vertically in translation, stressed towards its sealing position by means of a spring, referenced as 58. In the connection position, the lubricant flows from the source of lubricant through the mobile element and to the bore of the insert. The lubricant then flows from the bore of the chock, and to the bearings by the intermediary of the hollow of the shaft, referenced as 17, whereon the support arm is mounted pivoting.

When the intermediate rollers are separated by the camber blocks to their removal position, the travel of the mobile element is limited, less than the displacement travel of the camber blocks, as such making it possible to guarantee an inter-space between the mobile element and the chock, such as shown in FIG. 8 of document U.S. Pat. No. 6,041,636. It is then possible to remove the insert, without friction between the chocks and the mobile element.

Such a connection/disconnection device allows for the lubrication of the bearings of the support arms. However this document does not address the problem of the cooling of the working rollers. To the best knowledge of the inventors, still today the cooling of the intermediate and working rollers and the lubrication of the intermediate roller/working roller contact in a reversible rolling mill with "inserts" is still carried out by providing nozzles physically at a distance from the rollers.

It is however known from document EP 1.721.685 a rolling mill of the Sexto type laterally, improving the cooling of a working roller. This document proposes to improve the rolling mills of prior art with "cassettes", for which there would be no room to place cooling nozzles as close as possible to the roller barrels. FIG. 2 shows the object of the improvement of the anteriority EP 1 721 685.

The rolling mill is now a unidirectional rolling mill (not reversible) which comprises, upstream, according to the direction of scrolling of the strip, a side bearing roller, such as described hereinabove, supported by a support arm. Downstream, the support arm is devoid of a roller wheel or bearing roller. This bearing roller is replaced with a pad called a "support pad" which can be made of bronze or from a self-lubricating graphite material, intended to slide on the surface of the working roller barrel, without exerting any substantial force on the latter.

This support arm with pad embeds several nozzles for a cooling liquid which make it possible to directly cool the working roller barrel, on the downstream side. Downstream, the lubricating liquid is supplied to the nozzles by the intermediary of the hollow shaft of the corresponding support arm. Upstream, the hollow shaft of the support arm is used to convey the lubricant to the bearings of the roller wheels supporting the side bearing roller. This document teaches as such how to improve the cooling of the working rollers. However this improvement is carried out to the detriment of the supporting of the working roller on one of its sides, by suppressing a side bearing roller and by replacing it with a pad, as the rolling mill is then no longer a reversible rolling mill.

It is further known from document WO 2010/086514 a method and a device for spraying a rolling installation. This document covers more particularly the spraying of the working rollers supported laterally each by a pair of rollers, and comprising at least one pair of bearing rollers for the transmission of a rolling force. This document aims in particular to be an improvement of previously described document EP 1 721 685, a solution which would remain prohibited in reversible rolling mills.

According to this document, a direct spraying is provided of at least one portion of the working rollers, on either side of said plane perpendicular to the direction of scrolling of the strip.

According to this document, the nozzles are positioned on the supports of the side bearing rollers in order to directly spray the working roller of the two sides, laterally.

However, the technology described in this document WO 2010/0865514 is not a "cassette" technology as taught by documents U.S. Pat. Nos. 4,531,394, 6,041,636, EP 1.721.685 for which the set of intermediate roller, chocks of the intermediate roller, support arm, (right and left), roller wheels and side bearing rollers, right and left, forms a self-bearing unit, called "insert" which can be inserted into the stand or removed from the stand during maintenance, by sliding the unit according to the direction of the rollers.

The real difficulty in improving the spraying of the working rollers and of the intermediate rollers in a rolling mill with cassettes is not placing the spraying nozzles in the cassette, but knowing how to supply them with lubrication/cooling fluid, and without increasing the duration of maintenance during operations of removing or inserting the cassette in the stand of the rolling mill. For example, it is excluded to use hoses between the cassette and the stand of the rolling mill to supply the nozzles, because the latter would require being removed and remounted during operations of removing or introducing the cassette, which would substantially extend the time required for these maintenance operations.

Furthermore, and according to the observations of the inventor, placing the nozzles on the support of the side bearing roller in order to directly spray the working roller is not always possible, in particular when the working roller and the intermediate roller are of small diameter.

As described hereinabove, document U.S. Pat. No. 6,041,636 discloses automatic connection devices that make it possible, in the working position of the rollers, to connect the source of lubricant to lubrication bores provided in the chocks, and to automatically disconnect the bores when the intermediate rollers are separated vertically by the camber blocks. However, such a device can be used only for supplying lubricant, or only the bearings of the roller wheels of the side bearing roller of a support arm, or only to supply the nozzles of a support arm with fluid. That is the reason why the support arm of the nozzles is devoid of a side bearing roller in document EP 1.721.685, with the latter replaced with a pad which does not require any bearing to lubricate. Moreover, the connection device in this anteriority comes to connect to the chocks which requires a conveyance of the fluid according to a complex trajectory by the intermediary of the hollow shaft and to the lower end of the support arm. This trajectory of the fluid, complex, from the chock to the support arm, by the intermediary of the hollow shaft, generates load losses, which limits the flows.

In sum, and according to prior art to the best knowledge of the applicant, today, in reversible rolling mills of the Sexto type supported laterally, with cassettes, the cooling of the working rollers and of the intermediate rollers is carried out by means of nozzles placed outside of the cassette, physically at a distance from the working rollers and from the intermediate rollers and of which the streams cannot directly reach the working rollers. In this type of rolling mill implemented industrially, it is conventional to place a spray boom, on each side of the clamping plane, embedded on the load distribution beam of the stand and of which the streams are directed on the contact between the bearing roller and the intermediate roller. According to this arrangement, the lubrication of the working roller is therefore obtained, indirectly, by the fact that the intermediate roller was moistened and that this roller transports this lubrication during its rotation by a half-turn, to the working roller. According to the observations of the inventors, this lubrication is insufficient, in particular for the rollers placed under the strip.

Furthermore, and when the speed of the rolling mill becomes substantial, the centrifugal force at the circumference of the intermediate roller tends to spin the roller in such a way that little cooling fluid reaches the working roller.

The purpose of this invention is to propose a rolling mill that makes it possible to overcome the aforementioned disadvantages.

Another purpose of this invention is to propose such a rolling mill for which the cooling/lubrication systems do not complicate the maintenance operations of the rolling mill, and in particular the removal of the side bearing rollers.

Another purpose of this invention is to propose such a rolling mill for which the cooling/lubrication system authorises substantial flows of fluid.

Another purpose of this invention is to propose a rolling mill that authorises an effective cooling of the working rollers, even when the working roller or even the intermediate roller, are of small diameters.

Another purpose of this invention is to propose a rolling mill that authorises an effective cooling of the working rollers, even when the rolling mill is called to operate at a substantial speed.

Other purposes and advantages shall appear in the following description and which does not have for purpose to limit it.

The invention also relates to a rolling mill comprising:

- a retaining stand comprising two pairs of posts separated from each other at the two ends of the stand, at least two posts of the same pair defining an access window,
- two working rollers, able to surround a strip to be rolled, two bearing rollers, and two intermediate rollers, the bearing rollers and the intermediate rollers being mounted rotating at their ends on chocks,
- side bearing rollers, able to laterally support the working rollers, each side bearing roller being carried by a support arm, mounted pivoting on an axis,
- load distribution beams extending between the corresponding posts of each pair, and means for applying a preload force on each support arm, intended to engage with one of the support arms on a bearing surface, and comprising at least one preload cylinder integral with one of the load distribution beams,
- one or several spraying nozzles for a lubricant/cooling fluid.

According to the invention at least one of the nozzles is embedded on one of the support arms and wherein the circuit for the supply of fluid of said at least one nozzle comprises a connection/disconnection device comprising:

- a duct of the support arm, intended to channel the fluid, having a supply opening exiting on the bearing surface of the support arm intended to engage with the means for applying a preload force,
- a hollow portion, mobile in relation to the load distribution beam, that can be moved in relation to said load distribution beam under the action of said means for applying a preload force, able to carry out a sealed connection with the opening of a supply on the bearing surface in a first connection position of the device, or on the contrary retract to a second disconnection position, at a distance from the bearing surface.

According to optional characteristics taken individually or in combination:

- the hollow portion can be moved in translation, according to a substantially horizontal direction, under the action of said means for applying a preload force, thanks to a support element provided sliding in relation to said load distribution beam, with a ball-and-socket connection provided between the hollow portion and said support element;
- the hollow portion comprises a contact surface intended to form a sealed connection with the bearing surface of the support arm, as well as a hemispherical surface intended to cooperate with an additional recess of the support element, in order to constitute the ball-and-socket connection;
- the hemispherical surface is stressed towards the complementary recess by means of an elastic channelling having bellows, mounted in tension between the hollow portion and the support element;
- the supply circuit can include a hose between the support element, mobile, and the source of lubricant/cooling product.

According to an embodiment, each support arm of a side bearing roller is mounted pivoting on said axis, comprised of a shaft integral with the chocks of one of the intermediate rollers, with each intermediate roller, chocks of the intermediate roller, side bearing rollers and corresponding support arms forming a self-bearing unit, called an insert, which can be removed or introduced by sliding through the access window during maintenance.

In particular, each side bearing roller can be supported by bearing roller wheels, with the bearing roller wheels being mounted on axes of the support arms by the intermediary of bearings, and wherein the support arm comprises a circuit for supplying fluid for the lubrication of the bearings, separate from the supply circuit of said at least one nozzle. In particular, the supply circuit for the lubrication of bearings can comprise the shaft whereon is mounted pivoting the support arm, said shaft being hollow, such as known in the state of the art.

According to an advantageous embodiment, said at least one nozzle is directed in such a way that the stream is directed directly on the metal strip to be rolled and in such a way that the stream slides on the strip to be rolled to the working roller.

According to an advantageous embodiment, said at least one nozzle is directed in such a way that the stream is directed on the intermediate roller, in the vicinity of the contact zone between the working roller and the intermediate roller, and in such a way that driven by the intermediate roller, the fluid of the stream reaches the working roller.

The invention also relates to a method for cooling a rolling mill wherein the working roller is sprayed thanks to at least one nozzle, with the stream of the nozzle being powerful enough to reach said working roller by sliding on the strip to be rolled, going against the direction of scrolling of the strip to be rolled.

The invention shall be better understood when reading the following description, along with the annexed figures, among which:

Figure 1:
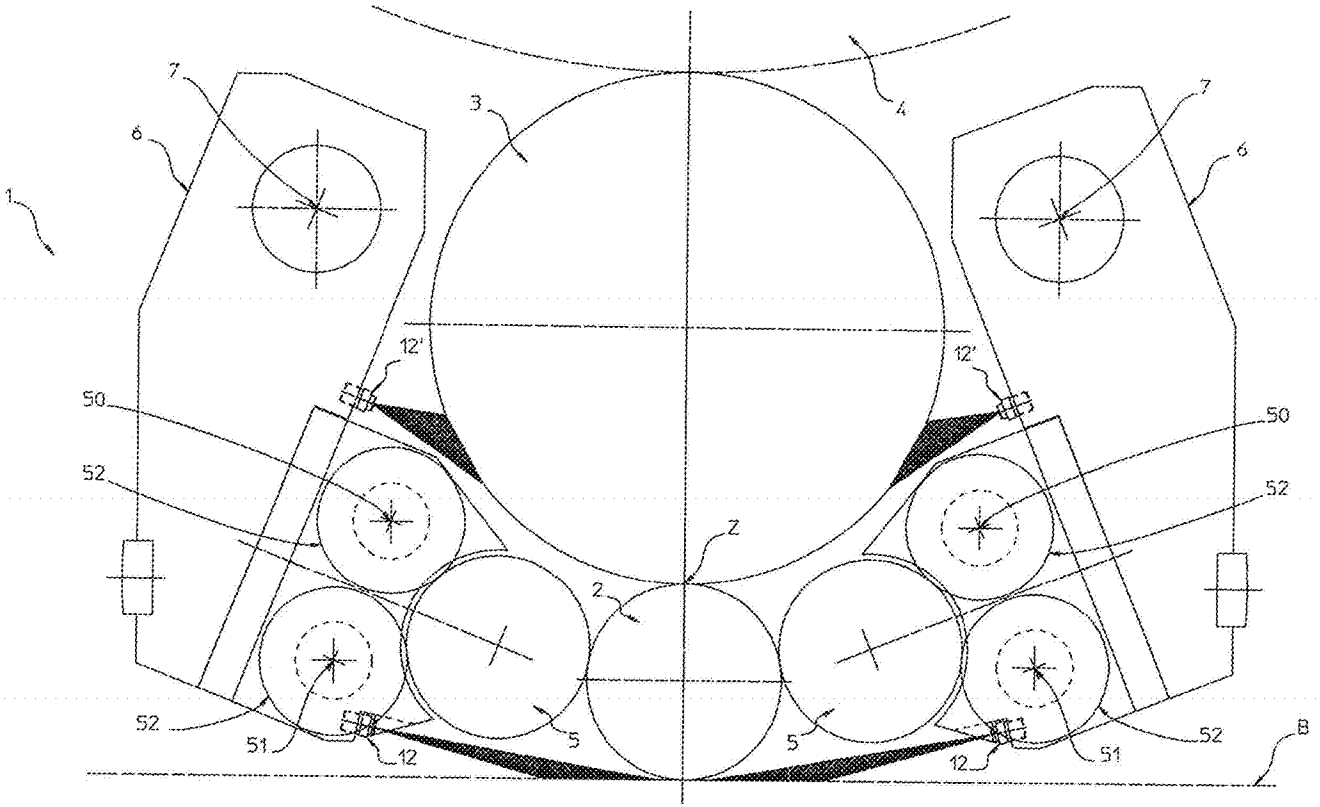
FIG. 1 is a partial view, of a rolling mill in accordance with the invention showing the upper portion of the rolling mill, and more particularly the bearing roller, the intermediate roller and the working roller, the side bearing rollers, as well as their support arm.

Also the invention relates first of all to a rolling mill 1 comprising:

- a retaining stand 30 comprising two pairs of posts 31 separated from each other at the two ends of the stand, at least two posts of the same pair defining an access window,
- two working rollers 2, able to surround a strip to be rolled, two bearing rollers 4, and two intermediate rollers 3, the bearing rollers 4 and the intermediate rollers 3, being mounted rotating at their ends on chocks,
- side bearing rollers 5, able to laterally support the working rollers 2, each side bearing roller being carried by a support arm 6, mounted pivoting on an axis 7,
- load distribution beams 8 extending between the corresponding posts of each pair, and means 9 for applying a preload force on each support arm 6, intended to engage with one of the support arms on a bearing surface 10, and comprising at least one preload cylinder 11 integral with one of the load distribution beams 8,
- one or several spraying nozzles for a lubricant/cooling fluid.

The working rollers 2, the intermediate rollers 3 and the bearing rollers 4 are substantially with parallel axes, with the axes of the rollers 2, 3, 4 being contained in a clamping plane substantially perpendicular to the strip to be rolled B. The two working rollers 2 are located on either side of the strip to be rolled, with their spacing defining the passage gap in operating. Each intermediate roller 3 is inserted between the working roller 2 and the corresponding bearing roller 4. The working roller is driven in rotation, indirectly by the putting into rotation of the intermediate roller 3.

The side bearing rollers 5 are more preferably of a number of two per working roller 2 and make it possible to maintain the working roller 2, laterally of the two sides of the clamping plane. This is as such more preferably a reversible rolling mill. Each side bearing roller 5 is mounted on a support arm 6 mounted pivoting on an axis 7.

According to an embodiment, each support arm 6 can be mounted pivoting on a shaft integral at its ends with the chocks of the intermediate rollers, such as taught by document U.S. Pat. No. 4,531,394 or document U.S. Pat. No. 6,041,636. In this rolling mill design, each intermediate roller 3, chocks of the intermediate roller, side bearing rollers 5 and corresponding support arms 6 form a self-bearing unit, commonly called "insert" or "cassette", which can be removed or introduced by sliding through the access window during maintenance.

Alternatively, and according to another embodiment taught by document WO 2011/107165 A1, each support arm 6 can be mounted pivoting on camber blocks, able to be moved vertically in relation to posts of the stand.

The load distribution beams 8 extending between the corresponding posts of each pair, respectively facing each support arm, at least during operating. The means 9 for applying a preload force on each support arm 6 are intended to engage with one of the support arms on a bearing surface 10, and comprise at least one preload cylinder 11 integral with one of the load distribution beam 8. The position of the load distribution beam 8 can be adjusted horizontally in relation to the posts 31. To this effect, synchronised screw/nut actuators 81 can be provided, in order to approach the load distribution beam towards the support arm 6, or on the contrary separate the load distribution beam 8 from said support arm 6. In operating, the working roller is generally constrained to press the side bearing roller 5 upstream, according to the direction scrolling of the strip B. The load distribution beam 8, downstream, is positioned a few millimeters from the support arm 6, downstream. The means 9 for applying a preload force are then used to take up the slack and provide the contact with the side bearing roller 5, downstream.

The rolling mill comprises said spraying nozzle or nozzles for a lubricant/cooling fluid, with these nozzles being in particular intended to cool/lubricant the working rollers, directly or indirectly and/or the other rollers of the rolling mill.

According to the invention, at least one of the nozzles 12, 12' is embedded in one of the support arms 6, in particular to allow for the lubrication/cooling of the working rollers and/or of the intermediate rollers.

Advantageously, the fluid supply circuit of said at least one nozzle 12, 12' comprises a connection/disconnection device 13 comprising:

- a duct 14 of the support arm 6, intended to channel the fluid, having a supply opening 15 exiting on the bearing surface 10 of the support arm 6 intended to engage the means 9 for applying a preload force, a hollow portion 16, mobile in relation to the load distribution beam, able to be moved in relation to said load distribution beam 8 under the action of said means 9 for applying a preload force.

According to the invention, this hollow portion 16 is able to form a sealed connection with the supply opening 15 on the bearing surface 10 in a first position of connection, or on the contrary, retract into a second disconnection position, at a distance from the bearing surface 10.

Figure 2:
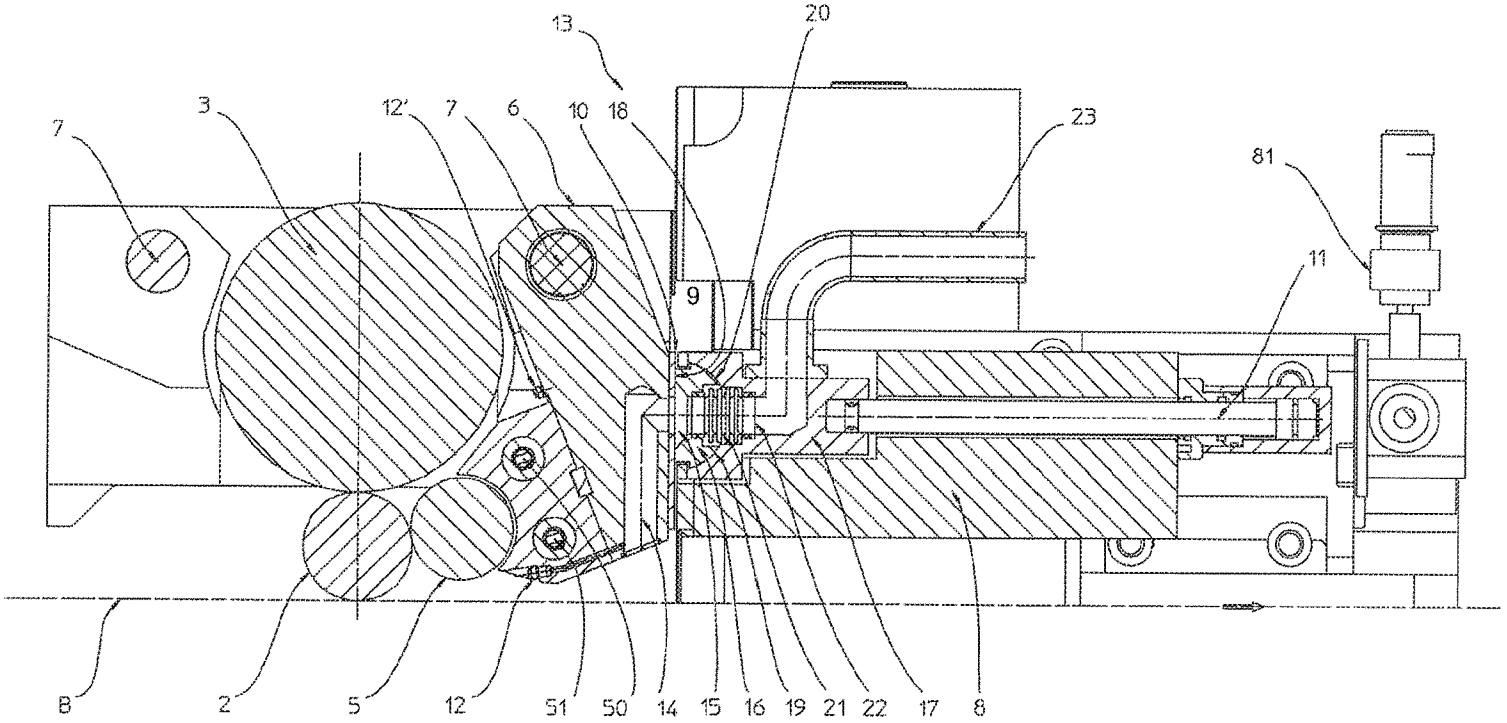
FIG. 2 is a partial view, of detail, showing a connection/disconnection device in said first connection position of the device.
Figure 3:
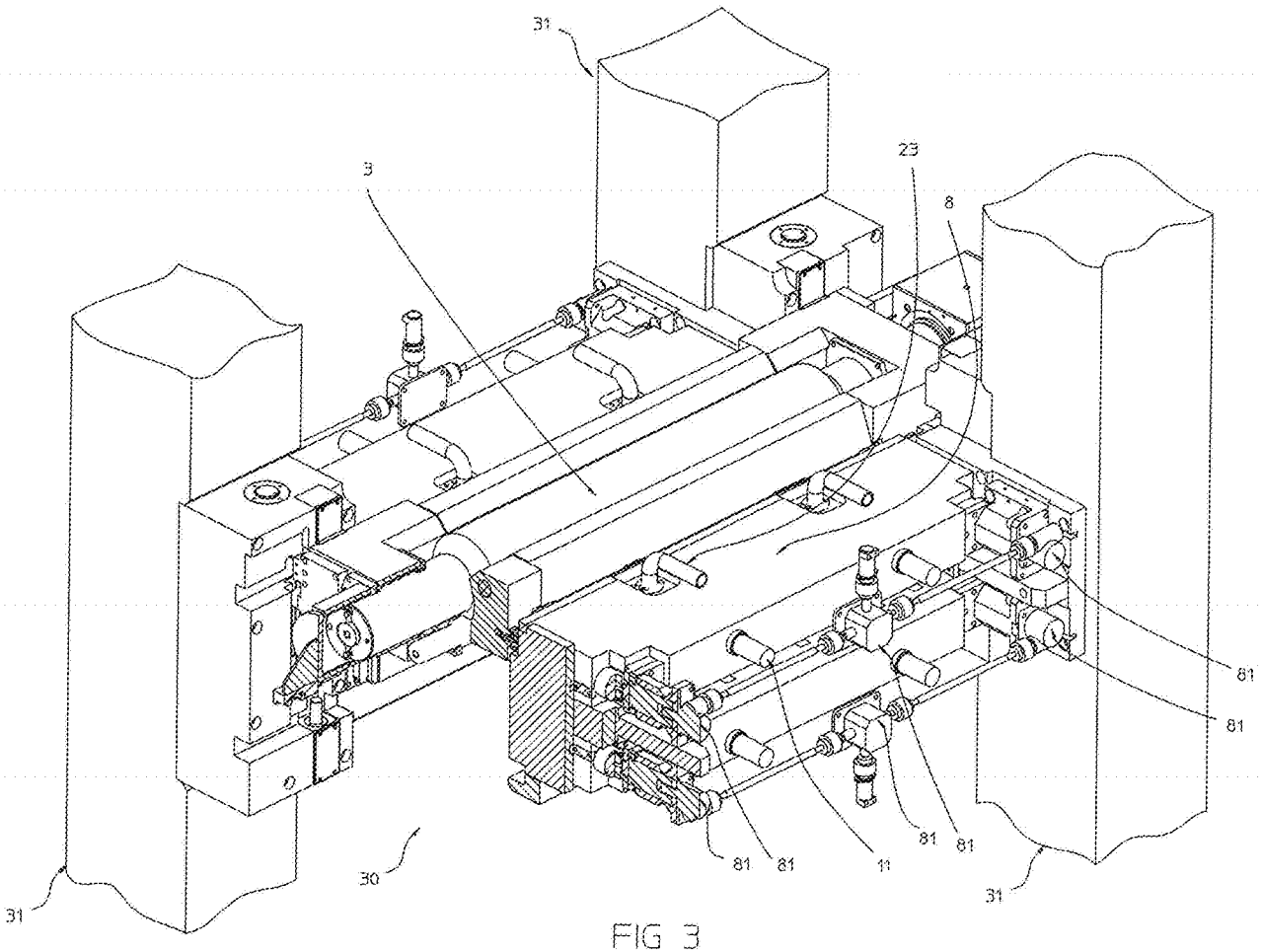
FIG. 3 is a perspective view of the retaining stand, and more particularly of the possibility of adjusting between the load distribution beam in relation to the posts of the stand.

In the first connection position, such as shown in FIG. 2, the cooling fluid can be channelled from the source to said at least one nozzle referenced as 12 (shown) or to said at least one nozzle referenced as 12' (not shown), by the intermediary of said connection/disconnection device.

In a second position of disconnection (not shown), the means 9 for applying a preload force are retracted, in retracted position, said hollow portion 16 being at a distance from the support arm 6. This position makes it possible, in particular when the design of the rolling mill is of the insert (or cassette) type to be able to remove or introduce the insert, without requiring additional maintenance time to disconnect/connect the source of fluid.

Another advantage of such a connection/disconnection device is that it directly connects to the support arm, not to the chocks of the intermediate roller as taught in prior art known from document U.S. Pat. No. 6,041,636. In order to reach the nozzle 12 or 12', in a rolling mill of the insert type according to the invention, the fluid does not need to pass through the hollow shaft whereon the support arm is mounted pivoting. It is then possible to obtain flow of fluid that are much higher than those obtained in this prior art.

In the invention, the hollow of the shaft can possibly be used, as in prior art to channel a fluid intended to lubricate the bearings of the roller wheels 52 laterally supporting the side bearing roller 5.

Also and according to an embodiment, each side bearing roller 5 is supported by roller wheels 52, with the roller wheels 52 being mounted on axes 50, 51, parallel, of the support arm 6 by the intermediary of bearings. The support arm 6 comprises a circuit for supplying with lubricant for the bearings, separate from the supply circuit of said at least one nozzle 12, 12'. The lubricant supply circuit for the bearings can comprise the shaft whereon is mounted pivoting the support arm 6, said shaft being hollow, with the lubricant passing through at least partially.

According to an embodiment, shown in an unrestricted manner in FIG. 1, the hollow portion 16 can be moved in translation, according to a substantially horizontal direction, under the action of said means for applying a preload force, thanks to a support element 17 provided sliding in relation to said load distribution beam 8. This support element 17 can slide on a bore of the load distribution beam, under the action of the cylinder 11 which can be dual-effect. When the cylinder 11, is deployed, the support element 17 and the hollow portion 16 are jointly moved in the direction of the support arm 6. Inversely, when the cylinder 11 retracts, the support element 17 and the hollow portion 16 separate from the support arm 17.

A ball-and-socket connection can be provided between the hollow portion 16 and said support element 17. This ball-and-socket connection makes it possible to provide that the contact surface 18 of the hollow portion 16, is inclined according to the plane of the bearing surface 10 of the support arm 6 in said connection position.

For example, according to the embodiment shown, the ball-and-socket connection comprises a hemispherical surface 19 of the hollow portion intended to cooperate with a recess of complementary shape 20 of the support element 17.

According to an embodiment, the hemispherical surface 19 is constrained towards the additional recess 20 by means of an elastic pipe 21 that has bellows 22, mounted in tension between the hollow portion 16 and the support element 17. This elastic pipe 17 makes it possible to maintain the hollow portion 16 on the support element 17. The bellows of the elastic pipe 21 provides the required elasticity so that the hollow portion 16 can pivot in the recess 20, according to a ball-and-socket connection.

The supply circuit can include a hose 23 between the support element 17, mobile, and the source of the lubricant/cooling product. In operating, in said first position of connection, the fluid arrives from the source, passes through the hose 23 to a bore of the support element 17, then flows into the elastic pipe 21, through the hollow portion 16, to reach the supply opening 15. Starting from this opening, the fluid flows in the support arm 6 through the duct 14 to said at least one nozzle 12 which can be integral with the support of the roller wheels 52, or said at least one nozzle 12' which can be integral directly on the body of the support arm 6.

Preferably, a plurality of nozzles 12 and/or 12' can be arranged over the length of the support arm 6 in such a way as to be able to cool the working roller and/or the intermediate roller over its entire length.

Preferably, said at least one nozzle 12 can be directed in such a way that the stream is directed directly on the strip to be rolled, not directly on the working roller, and in such a way that the stream slides on the strip to be rolled in the direction of the working roller 2.

Such an orientation of nozzles 12 makes it possible advantageously to effectively cool the working roller when the working roller and the intermediate roller are of small diameters and prohibit directly spraying the working roller.

This orientation of said at least one nozzle 12 makes it possible to cool the working roller, even when the stream is sprayed against the direction of scrolling of the strip to be rolled, such as shown in FIG. 2. This is rendered possible in that said at least one nozzle 12, supported by the pivoting arm 6 is located in the vicinity of the working roller, and in that the invention makes it possible to obtain a substantial flow of fluid. This proximity and such flows allow the stream to slide on the strip against the direction of scrolling of the strip until reaching the working roller.

Alternatively or additionally, said at least one nozzle 12' can be directed in such a way that the stream is directed on the intermediate roller 3, in the vicinity of the contact zone Z between the working roller 2 and the intermediate roller 3, and in such a way that driven by the intermediate roller, the fluid of the stream reaches the working roller 2.

The invention as such makes it possible to place one or several nozzles 12' on the support arms 6, in the vicinity of this zone Z, and as such spray the intermediate roller 3, as close as possible to this zone, and not only on the bearing roller 4/intermediate roller 3 contact zone, such as is known in prior art. Contrary to the rolling mill of prior art, when the intermediate roller 3 is driven in rotation at a substantial speed, the major portion of the fluid of the stream reaches the working roller 2, regardless of the action of the centrifugal force.

Such nozzles 12, 12' can be provided over all or a portion of the two support arms of the upper side bearing rollers and over all or a portion of the two support arms of the lower side bearing rollers.

According to an advantageous embodiment, the nozzles 12, 12' are provided on the four support arms, with a connection/disconnection device being provided between each support arm and the corresponding load distribution beam.

According to this last embodiment, the invention makes it possible to cool/lubricate:

each of the two working rollers, upper and lower, on either side of the clamping plane of the rolling mill, each of the two intermediate rollers, upper and lower, and also, the intermediate rollers 3 and working rollers 2 contact zones, in particular on either side of the clamping plane of the rolling mill.

Naturally, other embodiments could have been considered by those skilled in the art without however leaving the scope of the invention defined by the claims hereinafter.

NOMENCLATURE

1. Rolling mill,
2. Working roller,
3. Intermediate roller,
4. Bearing roller
5. Side bearing roller,
6. Support arm (Side bearing roller 5),
7. Pivoting axis (Support arm 6),
8. Load distribution beam,
9. Means for applying a preload force,
10. Bearing surface (Support arm 6),
11. Cylinder (Means for applying a preload force),
12. Spraying nozzles (on strip),
12'. Spraying nozzles (on intermediate roller barrel),
13. Connection/disconnection device,
14. Duct (Support arm),
15. Supply opening,
16. Hollow portion,
17. Support element,
18. Contact surface (Hollow portion 16),
19. Hemispherical surface (Hollow portion 16),
20. Recess (Support element 17),
21. Elastic pipe,
22. Bellows,
23. Hose
30. Retaining stand,
31. Posts,
50, 51 Axes (support of the roller wheels),
52. Roller wheels,
81. Screw/nut actuators,
B. Strip to be rolled,
Z. Working roller 2/intermediate roller 3 contact zone.

The invention claimed is:

1. A rolling mill (1) comprising:

a retaining stand (30) comprising two pairs of posts (31) separated from each other at two ends of the stand, at least two posts of one pair defining an access window, two working rollers (2), able to surround a strip to be rolled, two bearing rollers (4), and two intermediate rollers (3), the bearing rollers (4) and the intermediate rollers (3) being mounted rotating at ends thereof on chocks, side bearing rollers (5), able to laterally support the working rollers (2), with each side bearing roller being carried by a support arm (6), mounted pivoting on an axis (7), load distribution beams (8) extending between corresponding posts of each pair, and means (9) for applying a preload force on each support arm (6), intended to engage with one of the support arms on a bearing surface (10), and comprising at least one preload cylinder (11) integral with one of the load distribution beams (8), one or more spraying nozzles for providing a stream or streams of a lubricant/cooling fluid, wherein at least one of the nozzles (12, 12'), is embedded on one of the support arms (6) and a fluid supply circuit of said at least one nozzle (12, 12') comprises a connection/disconnection device (13) comprising:

a duct (14) of the support arm (6), intended to channel the fluid, having a supply opening (15) exiting on the bearing surface of the support arm intended to engage the means (9) for applying a preload force, a hollow portion (16), mobile in relation to the load distribution beam (8), which is moveable in relation to said load distribution beam (8) under action of said means (9) for applying a preload force, able to form a sealed connection with the supply opening (15) on the bearing surface (10) in a first position of connection, and retractable into a second position of disconnection, at a distance from the bearing surface (10).

2. The rolling mill according to claim 1, wherein the hollow portion (16) is moveable in translation, according to a substantially horizontal direction, under action of said means (9) for applying a preload force, a support element (17) being provided sliding in relation to said load distribution beam (8), a ball-and-socket connection being provided between the hollow portion (16) and said support element (17).

3. The rolling mill according to claim 2, wherein the hollow portion (16) comprises a contact surface (18) intended to form a sealed connection with the bearing surface (10), as well as a hemispherical surface (19) intended to cooperate with a complementary recess (20) of the support element, in order to constitute the ball-and-socket connection.

4. The rolling mill according to claim 3, wherein the hemispherical surface (19) is stressed towards the complementary recess (20) by means of a flexible pipe (21) that has bellows (22), mounted in tension between the hollow portion (16) and the support element (17).

5. The rolling mill according to claim 1, wherein the fluid supply circuit of said at least one nozzle (12, 12') comprises a hose (23) between the support element (17), mobile, and a source of lubricant/cooling fluid.

6. The rolling mill according to claim 1, wherein each support arm (6) of a side bearing roller (5) is mounted pivoting on said axis (7), constituted by a shaft integral with the chocks of one of the intermediate rollers (3), with each intermediate roller (3), chocks of the intermediate roller, side bearing rollers (5) and corresponding support arms (6) forming a self-bearing unit, called an insert, which can be removed or introduced by sliding through the access window during maintenance.

7. The rolling mill according to claim 6, wherein each side bearing roller (5) is supported by bearing roller wheels, with the bearing roller wheels being mounted on axes (50, 51) of the support arms (6) by an intermediary of bearings, and wherein the support arm (6) comprises a supply circuit of lubricant for the bearings, separate from the fluid supply circuit of said at least one nozzle (12, 12').

8. The rolling mill according to claim 7, wherein the supply circuit of lubricant for the bearings comprises the shaft whereon is mounted pivoting the support arm (6), said shaft being hollow.

9. The rolling mill according to claim 1, wherein said at least one nozzle (12') is directed in such a way that the stream of lubricant/cooling fluid is directed on the intermediate roller (3), in the vicinity of a contact zone (Z) between the working roller (2) and the intermediate roller (3), and in such a way that driven by the intermediate roller, the fluid of the stream reaches the working roller (2).

10. The rolling mill according to claim 1, wherein said at least one nozzle (12) is directed in such a way that the stream of lubricant/cooling fluid is directed directly on the strip to be rolled and in such a way that the stream of lubricant/cooling fluid slides on the strip to be rolled in a direction of the corresponding working roller (2).

11. A method for cooling a rolling mill according to claim 10, wherein the working roller is sprayed by a stream from at least one nozzle (12), with the stream of the nozzle being powerful enough to reach said working roller (2) by sliding on the strip to be rolled (B), against a direction of scrolling of the strip to be rolled.

12. The rolling mill according to claim 2, wherein the fluid supply circuit of said at least one nozzle (12, 12') comprises a hose (23) between the support element (17), mobile, and a source of lubricant/cooling fluid.

13. The rolling mill according to claim 2, wherein each support arm (6) of a side bearing roller (5) is mounted pivoting on said axis (7), constituted by a shaft integral with the chocks of one of the intermediate rollers (3), with each intermediate roller (3), chocks of the intermediate roller, side bearing rollers (5) and corresponding support arms (6) forming a self-bearing unit, called an insert, which can be removed or introduced by sliding through the access window during maintenance.

14. The rolling mill according to claim 2, wherein said at least one nozzle (12') is directed in such a way that the stream of lubricant/cooling fluid is directed on the intermediate roller (3), in the vicinity of the contact zone (Z) between the working roller (2) and the intermediate roller (3), and in such a way that driven by the intermediate roller, the fluid of the stream reaches the working roller (2).

15. The rolling mill according to claim 2, wherein said at least one nozzle (12) is directed in such a way that the stream of lubricant/cooling fluid is directed directly on the strip to be rolled and in such a way that the stream of lubricant/cooling fluid slides on the strip to be rolled in a direction of the corresponding working roller (2).

16. The rolling mill according to claim 3, wherein the fluid supply circuit of said at least one nozzle (12, 12') comprises a hose (23) between the support element (17), mobile, and a source of lubricant/cooling fluid.

17. The rolling mill according to claim 3, wherein each support arm (6) of a side bearing roller (5) is mounted pivoting on said axis (7), constituted by a shaft integral with the chocks of one of the intermediate rollers (3), with each intermediate roller (3), chocks of the intermediate roller, side bearing rollers (5) and corresponding support arms (6) forming a self-bearing unit, called an insert, which can be removed or introduced by sliding through the access window during maintenance.

18. The rolling mill according to claim 3, wherein said at least one nozzle (12') is directed in such a way that the stream of lubricant/cooling fluid is directed on the intermediate roller (3), in the vicinity of the contact zone (Z) between the working roller (2) and the intermediate roller (3), and in such a way that driven by the intermediate roller, the fluid of the stream reaches the working roller (2).

19. The rolling mill according to claim 3, wherein said at least one nozzle (12) is directed in such a way that the stream of lubricant/cooling fluid is directed directly on the strip to be rolled and in such a way that the stream of lubricant/cooling fluid slides on the strip to be rolled in a direction of the corresponding working roller (2).

* * * * *